US007379042B2

(12) United States Patent
Chang

(10) Patent No.: US 7,379,042 B2
(45) Date of Patent: May 27, 2008

(54) METHOD FOR DISPLAYING IMAGES ON ELECTROLUMINESCENCE DEVICES WITH STRESSED PIXELS

(75) Inventor: Yicheng Chang, Taipei (TW)

(73) Assignee: AU Optronics Corporation, Hsinchu (TW)

( * ) Notice: Subject to any disclaimer, the term of this patent is extended or adjusted under 35 U.S.C. 154(b) by 622 days.

(21) Appl. No.: 10/719,738

(22) Filed: Nov. 21, 2003

(65) Prior Publication Data

US 2005/0110807 A1 May 26, 2005

(51) Int. Cl.
*G09G 3/36* (2006.01)

(52) U.S. Cl. ..... 345/89; 345/690

(58) Field of Classification Search ..... 345/89, 345/690

See application file for complete search history.

(56) References Cited

U.S. PATENT DOCUMENTS 6,414,661 B1 7/2002 Shen et al.
6,552,735 B1 4/2003 Dehmlow
7,034,811 B2 * 4/2006 Allen ..... 345/204
2005/0052394 A1 * 3/2005 Waterman ..... 345/98

* cited by examiner

*Primary Examiner*—Amr A. Awad
*Assistant Examiner*—Michael Pervan
(74) *Attorney, Agent, or Firm*—Duane Morris LLP

(57) ABSTRACT

A method and system for compensating stressed pixels on a light-emitting diode (LED) based display device is disclosed. After receiving a video data input for displaying a video image frame at a first frequency, one or more pixels in the video image frame are detected as stressed pixels. Based on the information for the stressed pixels, a primary sub-frame is displayed, the primary sub-frame having one or more stressed pixels with at least one of whose display parameters being degraded due to an accumulative usage of the LED display device. At least one secondary sub-frame is then displayed having the detected stressed pixels thereon with the degraded display parameter compensated. The primary and secondary sub-frames are displayed sequentially at a second frequency so that the separation of these two sub-frames is undetected by a viewer.

13 Claims, 4 Drawing Sheets

METHOD FOR DISPLAYING IMAGES ON ELECTROLUMINESCENCE DEVICES WITH STRESSED PIXELS

BACKGROUND

The present disclosure relates generally to electro-optical display devices, and methods and systems for processing display images. More particularly, the present disclosure relates to the methods and systems for driving images on electroluminescence display devices with stressed pixels.

Common types of electroluminescence display devices utilize components of light-emitting devices to form image elements known as pixels. Pixels in typical display devices comprise of light-emitting diodes (LEDs) that emit monochromatic or white light. Pixels are typically arranged in a single-plane array and are each driven with time-based specific brightness, color, turn on/off and other display parameters from an image signal processor, to collectively display a specific image at a given time.

FIG. 1 illustrates a block diagram of a conventional display system 100 and the identification of some key components. Video pixel data 102 is shown as input into a processor/controller section 104 which will process the accumulated pixel data into display information for a whole video image frame. The processor/controller 104 may store and buffer the incoming video pixel data 102 and/or processed video image data into a memory device 106. When the processed video information is ready for display output, the data is then sent to each pixel of the video display device 108 to create an image frame. Each pixel of the video display device 108 is unique with its own assigned display parameters such as brightness, color and on/off state. Individual pixels may be identified as $P_{xy}$, where x and y correspond to planar x-y coordinate locations of the video display device's screen. The accumulated plurality of pixels, $P_{xy}$, which fill an entire planar screen array of the video display device 108 to complete a single video image, is known as a video image frame.

All LED types, such as organic light-emitting diodes (OLED), experience permanent, irreversible decrease in light output as the LED progresses in the usage life. These decreases are usually related to chemical and/or physical changes in the material components of the LED structures. These time-related decay characteristics result in display devices with pixels of varying age and light output as the display device ages in time. When a display device is used with static or repetitive images, the more frequently used pixels will exhibit significantly greater light output decay than relatively infrequently used pixels. These more frequently used pixels become "stressed" pixels, producing dimmer light output than their less frequently used neighbor pixels.

This phenomenon of pixel differential aging will also induce undesired artifacts upon the displayed images. When the display image is changed, the previous image can sometimes be visible as a reduced brightness overlay onto the new image as result of differential pixel aging. When past images become long lingering into the display via differential aging, a latent image is said to appear. Latent images can cause considerable distraction to a display user, and may impair correct interpretation of the displayed images. Since display usage cannot be predicted nor controlled, some means must be utilized to prevent latent images from becoming visible. It is not possible to completely eliminate the differential aging mechanism, so other means must be found to compensate for the effect.

FIG. 2 illustrates a typical video image processing methodology that attempts to correct visible image defects due to the differential aging mechanism of stressed pixels. Algorithms are incorporated into the video image processor/controller to determine compensation adjustments to the output of individual display pixels based upon past historical usage of each display pixel. The flow diagram of FIG. 2 shows the first step 202 of the methodology is to periodically sample individual video pixel data to capture the usage status of each pixel. The data sample period is dependant upon the design of the display system where typically, higher sample rates will provide higher compensation accuracy. It is also noted that to obtain high data sample rates, the size and capabilities of the display system's hardware may have to accommodate accordingly. The next step 204 of the methodology is to compile the usage history for each pixel, comprising of the results of all periodic samples of pixel data, are stored into a memory location(s). After a predetermined number of samplings, the third step of the methodology is to estimate the luminance decay status (step 206) of each pixel based upon the compiled usage history of each. One way to accomplish this estimation is by fitting the collected pixel history data into an established exponential LED aging equation to determine the luminance decay point of each pixel. The next step of the methodology 208 is to determine the lowest luminance values of pixels that have been used most frequently during a predetermined sample period. The methodology then determines a luminance correction factor for each pixel in the next step 210. The correction/compensation factor is typically calculated by a ratio of the lowest luminance values to the luminance decay point of the stressed pixels. The compensation/correction factors are then applied to the pixels' display parameters such that the luminance of the plurality of pixels appears to have equal age-related decay. As the corrections are applied to the stressed pixels, a corrected display image frame is said to be displayed upon the display device, as step 212 of the methodology.

This video image processing methodology provides a substantial solution to the elimination of most latent images and image defects due to aging and stressed pixels. It however, is an image correction methodology that is complex with its use of estimated luminance decay equations, pre-determined data sampling rates and assumed correlations concerning minimum and maximum luminance values to pixel usage. The complexities and assumptions may lead to produce certain image quality issues with the displayed images. Specifically, non-exact decay equations may lead to incorrect pixel values and uneven image brightness. Calculators for the equations may be dependant upon the calculators' accuracy capabilities with values such as floating point numbers. The stored, collected pixel data values may be incorrect due to insufficient data collection, storage and/or data sampling rates.

The above described method assumes correlations of minimum and maximum luminance values to pixel usage for setting the basis for adjustment so that the luminance of all pixels appears to have equal age-related decay. As the plurality of pixels actually age and the maximum luminance values drop, the display images using this correction methodology will experience lower overall brightness, or intensity of the video levels. The display device will also begin to experience lower image contrast levels, where the luminance or brightness range span becomes shorter with time.

What is needed are improved image display methods and systems that effectively correct for the issues related to the pixel differential aging mechanism and to stressed pixels.

SUMMARY

The present disclosure provides an accurate and precise image display method and system while not inducing any additional issues with image quality and display performance. The improved method and system is also of a simple structure and relatively easy to implement into a large variety of display devices and with different display technologies.

In one example, a method and system for compensating stressed pixels on a light-emitting diode (LED) based display device is disclosed. After receiving a video data input for displaying a video image frame at a first frequency, one or more pixels in the video image frame are detected as stressed pixels. Based on the information for the stressed pixels, a primary sub-frame is displayed, the primary sub-frame having one or more stressed pixels with at least one of whose display parameters being degraded due to an accumulative usage of the LED display device. At least one secondary sub-frame is then displayed having the detected stressed pixels thereon with the degraded display parameter compensated. The primary and secondary sub-frames are displayed sequentially at a second frequency so that the separation of these two sub-frames is undetected by a viewer.

These and other aspects and advantages will become apparent from the following detailed description, taken in conjunction with the accompanying drawings, illustrating by way of example the principles of the disclosure.

DESCRIPTION

The present disclosure describes an improved method and system for effectively correcting the defective image issues related to the pixel differential aging mechanism and to stressed pixels. The disclosed method does not induce any additional image quality and display issues, and is relatively easy to implement into a large variety of display devices and display technologies.

Figure 1:
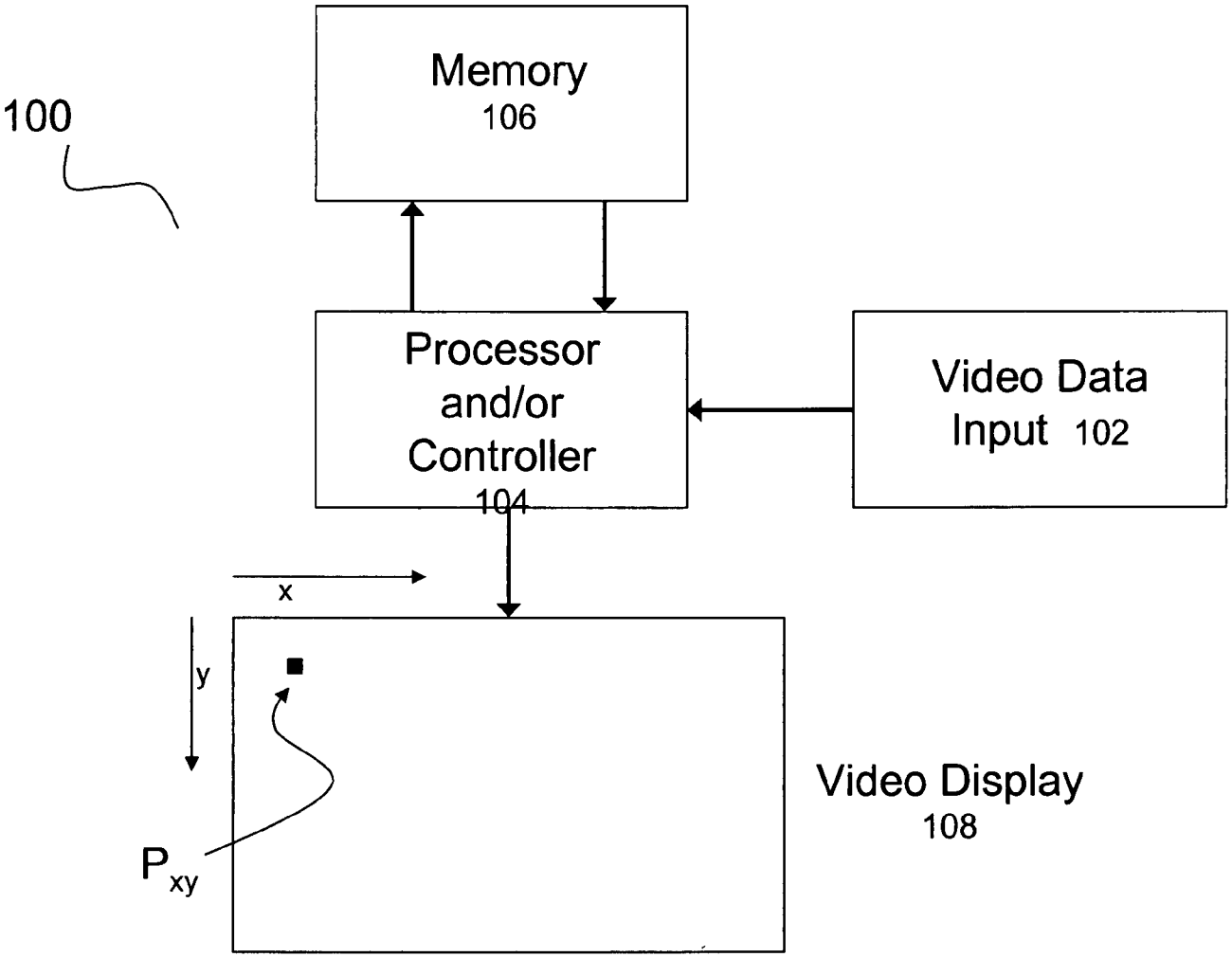
FIG. 1 is a block diagram illustrating key components of a typical video display system.
Figure 2:
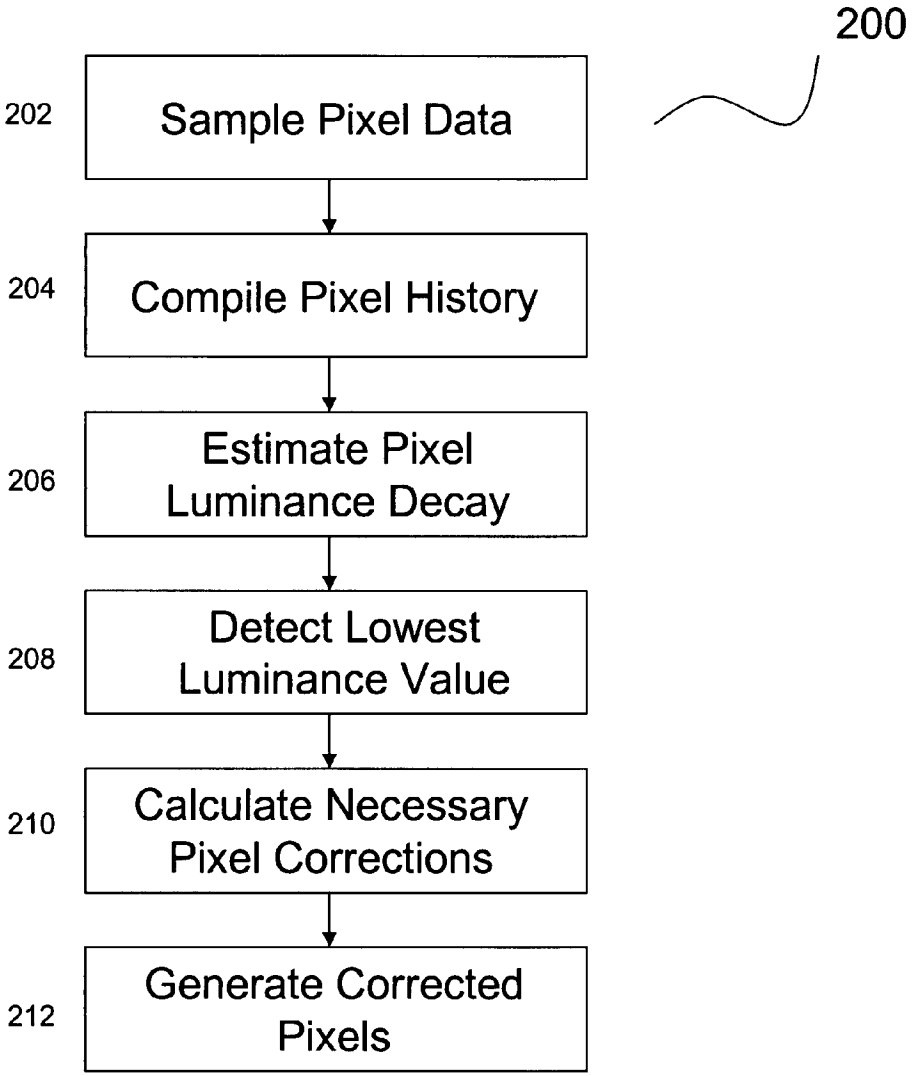
FIG. 2 is a flow diagram summarizing steps taken by a typical image processing methodology for the correction of stressed pixels due to differential aging.
Figure 3:
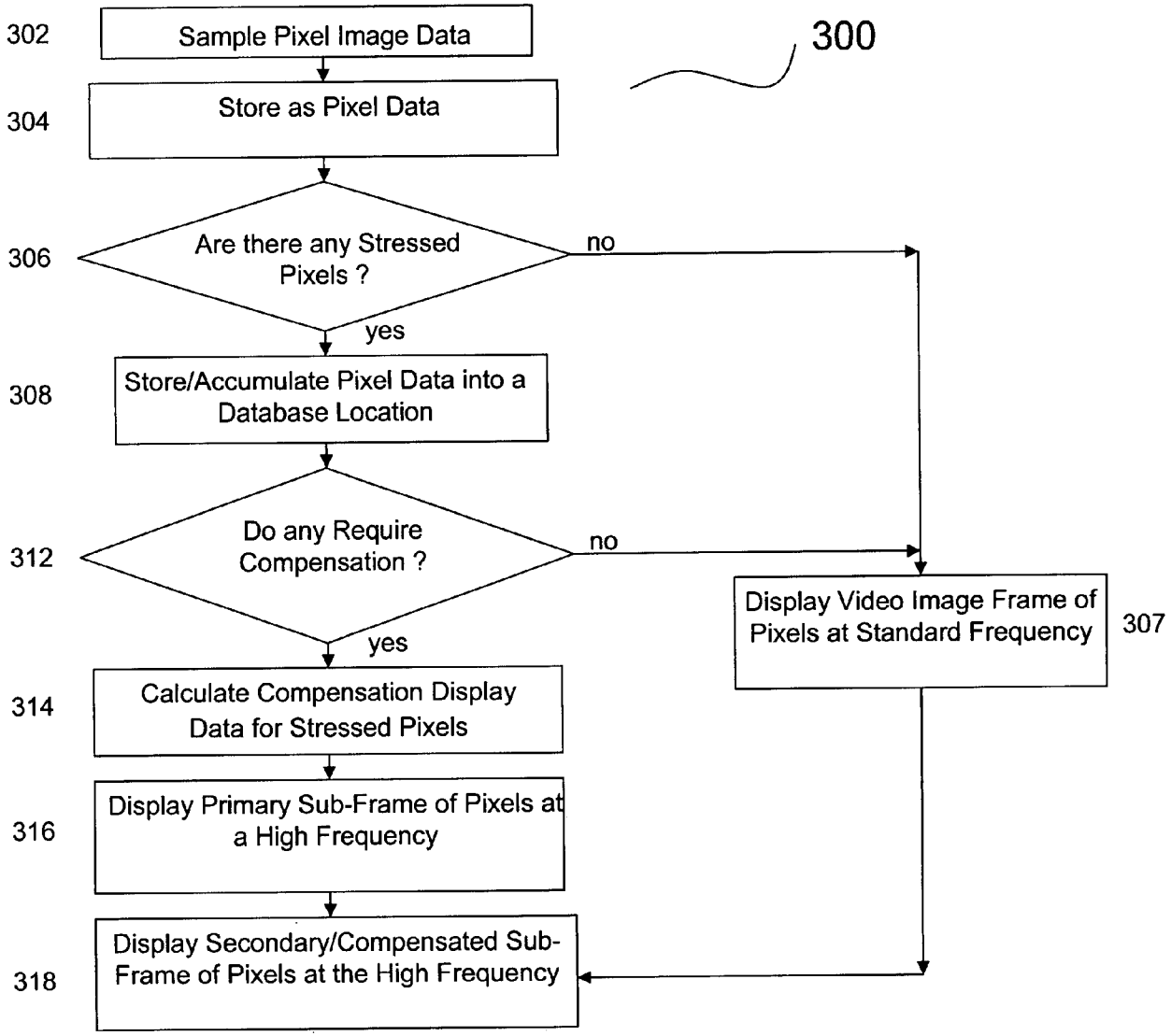
FIG. 3 is a flow diagram summarizing steps taken by an improved image processing method for compensating stressed pixels according to one example of the present disclosure.

FIG. 3 is a flow diagram 300 illustrating a video image processing methodology according to one example of the present disclosure that corrects visible image defects due to the differential aging mechanism of stressed pixels. The flow diagram 300 details how each pixels' display parameters are processed for each video image frame. In step 302, periodically sampling individual video pixel data is done to capture the display parameters of each pixel. The sampled pixel data is stored into a designated memory location or database in step 304. The database can include all relevant information about display parameters with regard to the pixels that are subject to degradation, especially with regard to the brightness level of the pixel. The data stored is accumulative. For example, if a particular pixel has been having a brightness level of 100 nits for three continuous sampling periods, the accumulative brightness level for that pixel is said to be at 300 nits. A subset of this database may only include pixels that are deemed to be overly stressed. For illustration purposes below, only brightness level is used as an example, but it is understood that any other display parameter that degrades over the life of the display device can equally be compensated using the methods described below.

When video data input for a video image frame is received for display, each pixel, $P_{xy}$, is then checked to determine if any pixel is already deemed to be stressed in step 306. Since there already exists a database that holds the pixel display information or pixel data based on data processing of prior video image frames, stressed pixels may be determined by checking an accumulative brightness level of each pixel (in terms of "nits"). The more a pixel is used, the more likely that it is subject to decay, and the brightness level or nits level is a good indication. The nits level is then checked against a pre-determined threshold designated as the threshold nits level at which pixel stress is deemed to begin. Simply put, any pixel that is driven to a nits level that is above the stress threshold is said to be stressed and will display a degraded image. If there is no pixel identified as being stressed in the video image frame per the examination in step 306, then all pixels of the video image frame are processed for display in step 307. The video image data is processed and transferred to the display device and shown with a regular frame display frequency. It is noted that the frame display frequency (frame rate) of the non-stressed pixels usually occurs at a default or baseline frequency of the display device.

In step 306, when the video image frame is examined, pixels that have been identified as stressed pixels in the database are to be singled out. The pixel data for the new video image frame is then accumulated in the database in step 308. On the other hand, if some pixels in the video image frame that were below the threshold nits level, but with the newly required brightness, they will be "stressed", these new found stressed pixels may also be added in the database.

As to stressed pixels identified, it is further examined whether any correction or compensation is required. This can be done through the calculation of additional pixel display parameters for the stressed pixels. The video processor/controller may use one or several criteria or trigger methods to determine whether pixel compensation is required. One criterion involves the judgment of the accumulated pixel data held in the database. As the data for each stressed pixel accumulates for each $P_{xy}$, a pre-determined compensation threshold may be established such that the stressed pixels will be compensated when the accumulated pixel data reaches the compensation threshold. It is noted that the compensation threshold may be different from the stress threshold, but they can also be the same.

Alternatively, other compensation trigger mechanisms may include a pixel life-time based or some other user-defined software or hardware based criteria. For example, whether a pixel needs compensation can also depend on how many neighboring pixels are also in need of compensation. A single pixel out of a large number of pixels in a large display area may not independently warrant the compensation.

The compensation calculation step 314 utilizes at least one algorithm applied to the stored pixel data. The algorithm calculates and partitions image data for each pixel $P_{xy}$ location into two or more video image sub-frames. The primary video image sub-frame may not be too different from the originally desired video image frame, and may comprise of the display parameters for all pixel locations, stressed and non-stressed. The secondary video image sub-frame is largely a compensation sub-frame, and may comprise of the compensating display data for the stressed pixels as identified. For example, the video processor/controller utilizes the accumulated pixel data that stored in the database to estimate the nits level loss due to the brightness decay of the identified stressed pixels. The video processor/controller then calculates the compensating nits level that are required to be additionally applied to the stressed pixels in order for their visual display to match that of the non-stressed pixels. The calculated compensating data with regard to the identified display parameter (e.g., brightness level) will be applied in the secondary sub-frame for display.

Since a video image frame can be comprised of sequential displays of all associated sub-frames, the primary video image sub-frame is displayed first in step 316 and the secondary sub-frame is subsequently displayed in the following step 318. As such, both the pixel data in the primary sub-frame and the calculated, compensating pixel data applied as the secondary sub-frame are transferred to the display device to be displayed as the complete video image frame. From the perspective of the viewer, the original video image frame is unaltered and displayed in front of her, and the separate of these two sub-frames are undetected by her.

As previously noted, the display of video image frames that consists entirely of non-stressed pixels, occur as single video frames at some baseline video image frame display frequency of the display device. In order to make the separation of the primary and secondary sub-frames undetected by a viewer, the two sub-frames are displayed at a higher frequency than the usual uncompensated video image frame display. For example, to integrate the primary and secondary sub-frames pairs for the compensated video images in a visually smooth, seamless manner, the individual sub-frames are displayed sequentially at a frame rate twice as much as the display device's baseline frequency. Further, it is also understood that there can be more than two sub-frames for display, and the display frequency can be proportionally higher than the baseline frequency. In order to achieve the sequential display of multiple sub-frames, the video processor/controller may have a timing generator or any similar functional module embedded therein to help detecting when the secondary sub-frame(s) needs to be provided and at what frequency.

Figure 4:
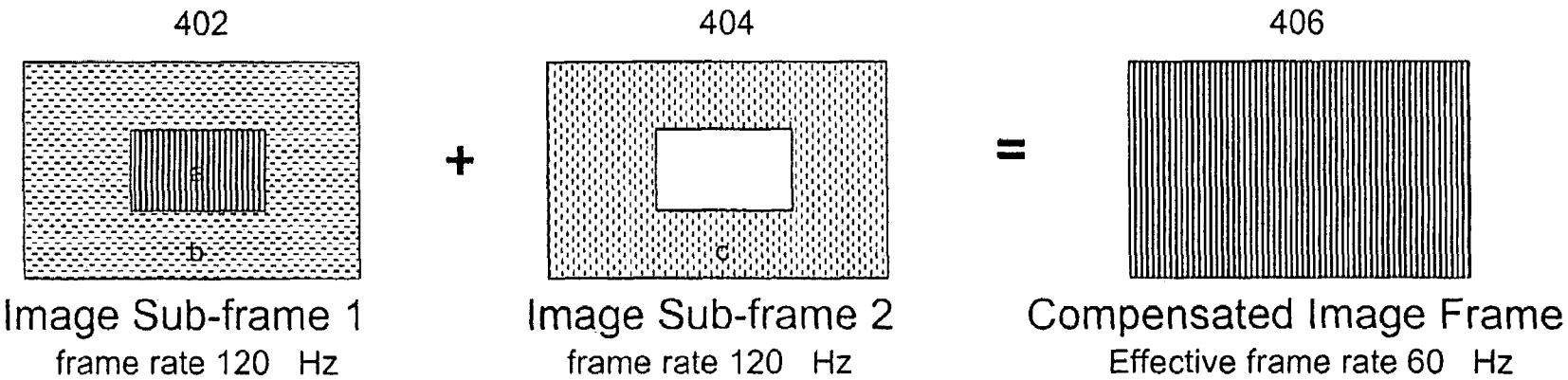
FIG. 4 illustrates the use of multiple sub-frames for producing images with stressed pixels compensated in accordance with the present disclosure.

Referring to FIG. 4, an example of the primary and secondary video image sub-frames integration is illustrated. It is assumed, for illustration purposes, that the display device's baseline video image frame display frequency is 60 Hz for a single frame of pixel data. The integration of two video sub-frames, the primary and the secondary frames, will require individual video image frame display frequency to be at 120 Hz.

It is assumed that a video image frame is desired to be displayed. If it is displayed uncompensated, due to the stressed pixels, the display can be like the primary sub-frame 402, which has both a non-stressed pixel area "a" and stressed pixel area "b". After stressed pixel detection and compensation calculation, a secondary sub-frame 404 is identified as a compensation sub-frame to be displayed after the primary sub-frame 402 is shown on the display device. In the secondary sub-frame 404, an adjusted, compensating pixel area "c" will be displayed over the stressed pixel area "b" of the primary sub-frame 402 while leaving its center portion blank so that it does not interfere the regular non-stressed pixel area "a" of the primary sub-frame.

Both the primary and the secondary sub-frames are shown displayed at a video image frame frequency of 120 Hz, twice as much as the baseline frequency. The resultant sequential display of the two sub-frames 402 and 404 provides the viewer with a compensated and complete video image frame at an effective display frequency of 60 Hz, matching that of the display device's baseline frequency. From the perspective of the viewer, the effective video image frame 406 is displayed at an effective 60 Hz display frequency with no discernable visual differences among the pixels of the video image frame.

It is noted that the primary sub-frame does not have to be the same as the original video image frame. After initial data processing, as long as the combination of the primary and secondary sub-frames displayed is equivalent to the display of the original video image frame, the primary and secondary sub-frames can have different pixel data to complement each other. In another words, the primary sub-frame may only need to represent a part of the original video image frame, and leave the rest for the secondary sub-frames to complement the data provided in the primary sub-frame.

Another example of the primary and secondary sub-frame integration can be used for further describing the invention. When a plurality of pixels are expected to have 100 nits uniformly, the stressed pixels of a primary video image sub-frame are displayed at a nits level lower than 100 nits due to stressed pixel decay and the non-stressed pixels within the same sub-frame displayed at 100 nits. Knowing the possibility of degradation, the stressed pixels as displayed by the primary sub-frame are corrected and compensated for in the secondary sub-frame by displaying the same at an additional 100 nits at a display video image frequency of 120 Hz. The stressed pixels are thus corrected and compensated as they are effectively displayed at 100 nits with a 60 Hz frame refresh rate. On the other hand, the non-stressed pixels of the primary sub-frame can be displayed at 100 nits and not receiving any additional compensation display data for the secondary sub-frame so that it will also exhibit an effective display of 100 nits at a frequency of 60 Hz.

As such, as long as the stressed pixels of the original video image frame is detected, the compensation algorithm of the video processor/controller will dynamically provide updated compensation data for the stressed pixels, and form the primary and secondary sub-frames for effectively displaying the desired image.

The video image processing method and system used in accordance with the present disclosure provides a substantial solution to the elimination of most latent images and image defects due to aging and stressed pixels without any additional undesired video image quality and display issues. Simple and less complex algorithms using fewer inputs and fewer assumed or estimated parameters provide for a more accurate compensation mechanism. The use of compensating pixel data applied to sequential sub-frames of image display parameters to supplement a primary sub-frame allows for full compensation of a large variety of pixel age/decay conditions for a large variety of video images.

This compensation method and system not only satisfy the goal of having the luminance of the plurality of pixels appearing to have equal age-related decay, but also maintain the overall brightness and intensity of the video image levels. The contrast levels and luminance range capabilities of the pixels are very stably maintained throughout the life of the display device.

The method disclosed is suitable and compatible for implementation within existing, conventional and future display technologies. The above disclosure provides several examples for implementing the different features of the disclosure. Specific examples of components and processes are described to help clarify the disclosure. These are, of course, merely examples and are not intended to limit the scope of the disclosure from that described in the claims.

While the invention has been particularly shown and described with reference to the preferred embodiment thereof, it will be understood by those skilled in the art that various changes in form and detail may be made therein without departing from the spirit and scope of the disclosure, as set forth in the following claims.

What is claimed is:

1. A method for compensating stressed pixels on a display device, the method comprising:

receiving a video data input for displaying a video image frame at a first frequency;

detecting one or more pixels in the video image frame as one or more stressed pixels;

determining compensating brightness for each of the stressed pixels;

forming a primary and a secondary sub-frame based on the determined compensating brightness;

determining a second frequency based on the determined compensating brightness;

displaying the primary sub-frame representing at least a part of the video image frame, the primary sub-frame having the stressed pixels whose brightness is expected to be compensated; and displaying at least one secondary sub-frame having the predetermined stressed pixels thereon with predetermined compensating brightness, wherein the primary and secondary sub-frames are displayed separately and sequentially at the second frequency, which is different from the first frequency, so that the separation of the two sub-frames is not detectable by a viewer.

2. The method of claim 1 wherein the primary and secondary sub-frames are displayed with the second frequency so that an effective display frequency is equivalent to the first frequency.

3. The method of claim 1 wherein the determining further comprises:

providing a database supplying accumulative pixel data for one or more stressed pixels, the accumulative pixel data indicating at least an accumulative brightness of each pixel; and comparing one or more pixels in the video image frame against the database to identify the stressed pixels.

4. The method of claim 3 further comprises accumulating pixel data in the database with regard to the identified stressed pixel based on the pixel data thereof for displaying the video image frame.

5. A method for compensating stressed pixels on a light-emitting diode (LED) based display device, the method comprising:

receiving a video data input for displaying a video image frame at a first frequency;

detecting one or more pixels in the video image frame as stressed pixels;

determining compensation display data with regard to the degraded parameter for each of the stressed pixels;

forming a primary and a secondary sub-frame based on the determined compensation data;

determining a second frequency based on the determined compensation data;

displaying the primary sub-frame representing at least a part of the video image frame, the primary sub-frame having one or more stressed pixels, at least one of whose display parameters is degraded due to an accumulative usage of the LED display device; and displaying at least one secondary sub-frame complementing the primary sub-frame and having the detected stressed pixels thereon with the degraded display parameter compensated, wherein the primary and secondary sub-frames are displayed sequentially at the second frequency, which is different from the first frequency, so that the video image frame is displayed without making the sequential displaying of the two sub-frames detectable by a viewer.

6. The method of claim 5 wherein the primary and secondary sub-frames are displayed with the second frequency so that an effective display frequency is equivalent to the first frequency.

7. The method of claim 5 wherein the detecting further comprises comparing pixels in the video image frame against a database supplying accumulative display data for one or more stored stressed pixels, the accumulative pixel data indicating at least one display parameter has been degraded.

8. The method of claim 7 further comprises accumulating the pixel data in the database with regard to the identified stressed pixel according to the displayed primary and secondary sub-frames.

9. The method of claim 5 wherein the degraded display parameter is a brightness level of the pixel.

10. A system for compensating stressed pixels on a light-emitting diode (LED) based display device, the system comprising:

means for receiving a video data input for displaying a video image frame at a first frequency;

means for processing information for one or more stressed pixels in the video image frame, wherein the means for processing comprises means for determining compensation display data with regard to at least one degraded parameter for each of the stressed pixels;

means for displaying a primary sub-frame and at least one secondary sub-frame sequentially at a second frequency, which is different from the first frequency, so that the sequential displaying of the primary and secondary sub-frames is not detectable by a viewer, wherein the primary sub-frame has the stressed pixels with the display parameters being degraded due to an accumulative usage of the LED display device, and the secondary sub-frame has the detected stressed pixels thereon with the degraded display parameter compensated; and means for:

forming the primary and secondary sub-frames based on the determined compensation data; and determining the second frequency based on the determined compensation data.

11. The system of claim 10 wherein the primary and secondary sub-frames are displayed with the second frequency so that an effective display frequency is equivalent to the first frequency.

12. The system of claim 10 wherein the means for processing further comprises means for comparing pixels in the video image frame against a database supplying accumulative display data for one or more stored stressed pixels, the accumulative pixel data indicating at least one display parameter has been degraded.

13. The system of claim 10 wherein the means for processing is a video processor or controller with predetermined processing algorithms embedded therein.

* * * * *